US006793523B1

(12) United States Patent
Wei

(10) Patent No.: US 6,793,523 B1
(45) Date of Patent: Sep. 21, 2004

(54) POWER SOCKET HAVING ATTACHED CONTAINER

(76) Inventor: Jose Wei, No. 17-2, Pai Ling 1st Rd., Hsin Tien City, Taipei Hsien (TW)

( * ) Notice: Subject to any disclaimer, the term of this patent is extended or adjusted under 35 U.S.C. 154(b) by 0 days.

(21) Appl. No.: 10/673,503

(22) Filed: Sep. 30, 2003

(30) Foreign Application Priority Data

Jul. 11, 2003 (TW) ..... 92212766 U

(51) Int. Cl.[7] ..... H01R 13/72
(52) U.S. Cl. ..... 439/501
(58) Field of Search ..... 439/501, 576

(56) References Cited

U.S. PATENT DOCUMENTS 5,378,166 A * 1/1995 Gallagher, Sr. ..... 439/214
6,352,447 B1 * 3/2002 Ruth ..... 439/540.1
6,410,994 B1 * 6/2002 Jones et al. ..... 307/36
6,428,184 B1 * 8/2002 Huang ..... 362/226
6,561,673 B2 * 5/2003 Frederick ..... 362/234
6,619,980 B1 * 9/2003 Hsiao ..... 439/501
6,666,712 B1 * 12/2003 Kramer ..... 439/501

* cited by examiner

*Primary Examiner*—Gary Paumen
(74) *Attorney, Agent, or Firm*—Dennison, Schultz, Dougherty & MacDonald

(57) ABSTRACT

A power socket having an attached container includes a socket housing having an extension wire, and a container serving as a cover or a container. Using the structure according to the invention, wires can be effective stored while accomplishing waterproof purposes.

5 Claims, 8 Drawing Sheets

POWER SOCKET HAVING ATTACHED CONTAINER

BACKGROUND OF THE INVENTION (a) Field of the Invention

The invention relates to a power socket having an attached container, and more particularly, to a power socket having an extension wire, and a power socket housing wedged and joined with a container. The power socket according the invention is capable of storing a power wire into the container when the socket is not in use. In addition, the socket is wedged into the container with the container to serve as an elevated body or an outer cover of the socket, thereby accomplishing waterproof purposes of the socket.

(b) Description of the Prior Art

Referring to FIG. 8 showing a common extension power socket A, the extension power socket A has an extended power wire W with a certain length. This prior structure is prone to the shortcomings below when using in the long term:

1. When the extension power socket A is being used, the power wire W is entirely placed on the ground regardless of the distance between power receptacles and the power socket A. Not only a mess on the ground is resulted, but possibility of tripping one's feet Is also increased.
2. When the extension power socket A is not in use, the power wire W cannot be effectively and readily stored, and hence the power wire W appears to be always tangled.
3. When this prior structure is used in surroundings with mist or water splashes, short circuits are often caused owing to accidental water seepage into insertion openings A1 of the extension power socket A.

In the view of the above, it is a vital task of the invention as how to overcome these shortcomings.

SUMMARY OF THE INVENTION

Therefore, a primary object of the invention is to provide a power socket having an attached container, with a lower surface of a socket housing thereof being elevated using the attached container, an upper surface of the socket housing being covered using the attached container, thereby accomplishing waterproof and moisture-proof purposes.

The other object of the invention is to provide a power socket having an attached container, so as to effectively and readily store an extension wire into an interior of the container.

DETAILED DESCRIPTION OF THE PREFERRED EMBODIMENTS

To better understand the invention, detailed descriptions shall be given with the accompanying drawings hereunder.

Figure 1:
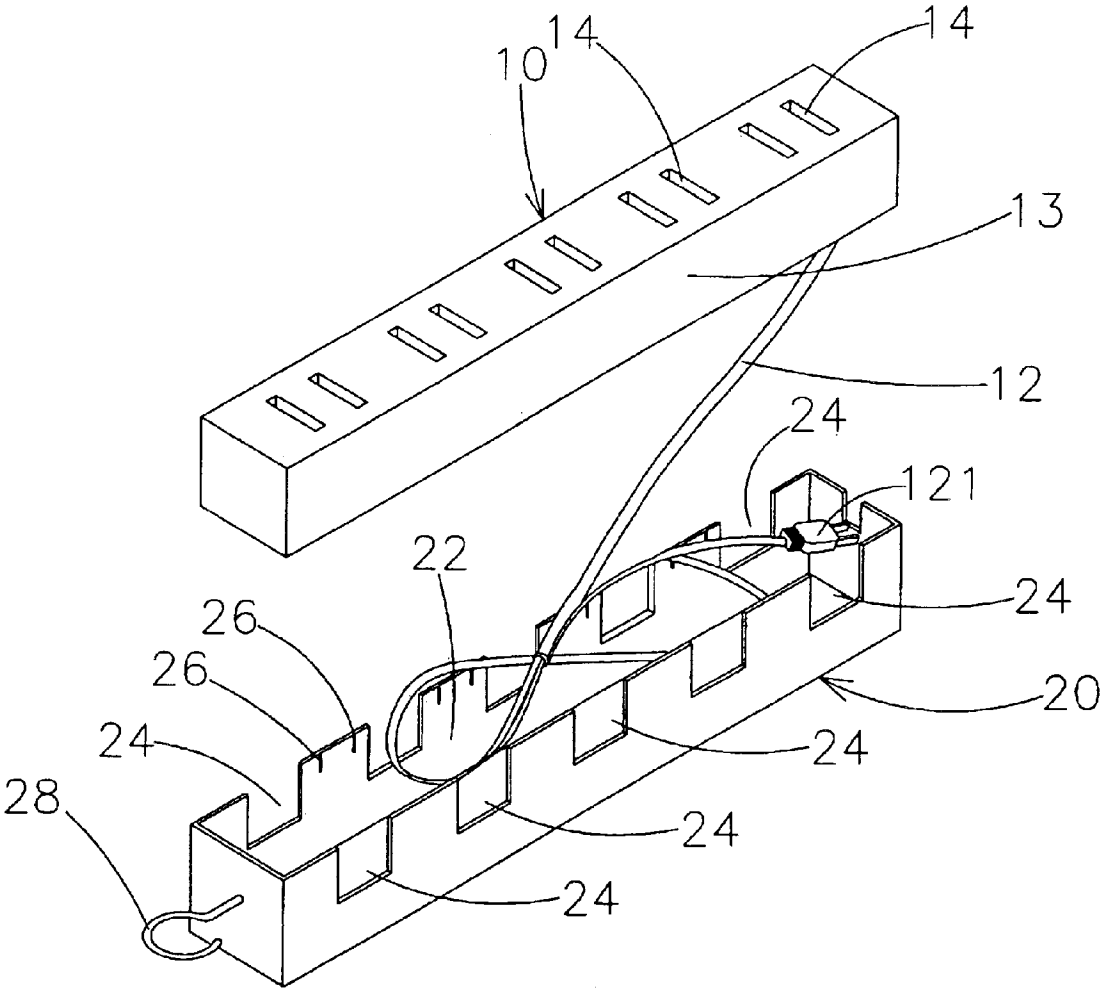
FIG. 1 shows an exploded elevational view according to the invention.

Referring to FIG. 1, the device according to the invention comprises the characteristics of:

- a socket housing 10 with an extension wire 12, and having insertion openings 14; and
- a container 20 having an accommodating chamber 22, wherein an exterior 13 of the socket housing 10 is wedged into the accommodating chamber 22, and the container 20 forms an outer cover by covering and joining at an upper surface of the socket housing 10 and forms elevated body by covering a lower surface of the socket housing 10.

According to the aforesaid primary characteristics, wherein side walls of the container 20 have at least one notch 24 as shown in FIG. 1.

Figure 7:
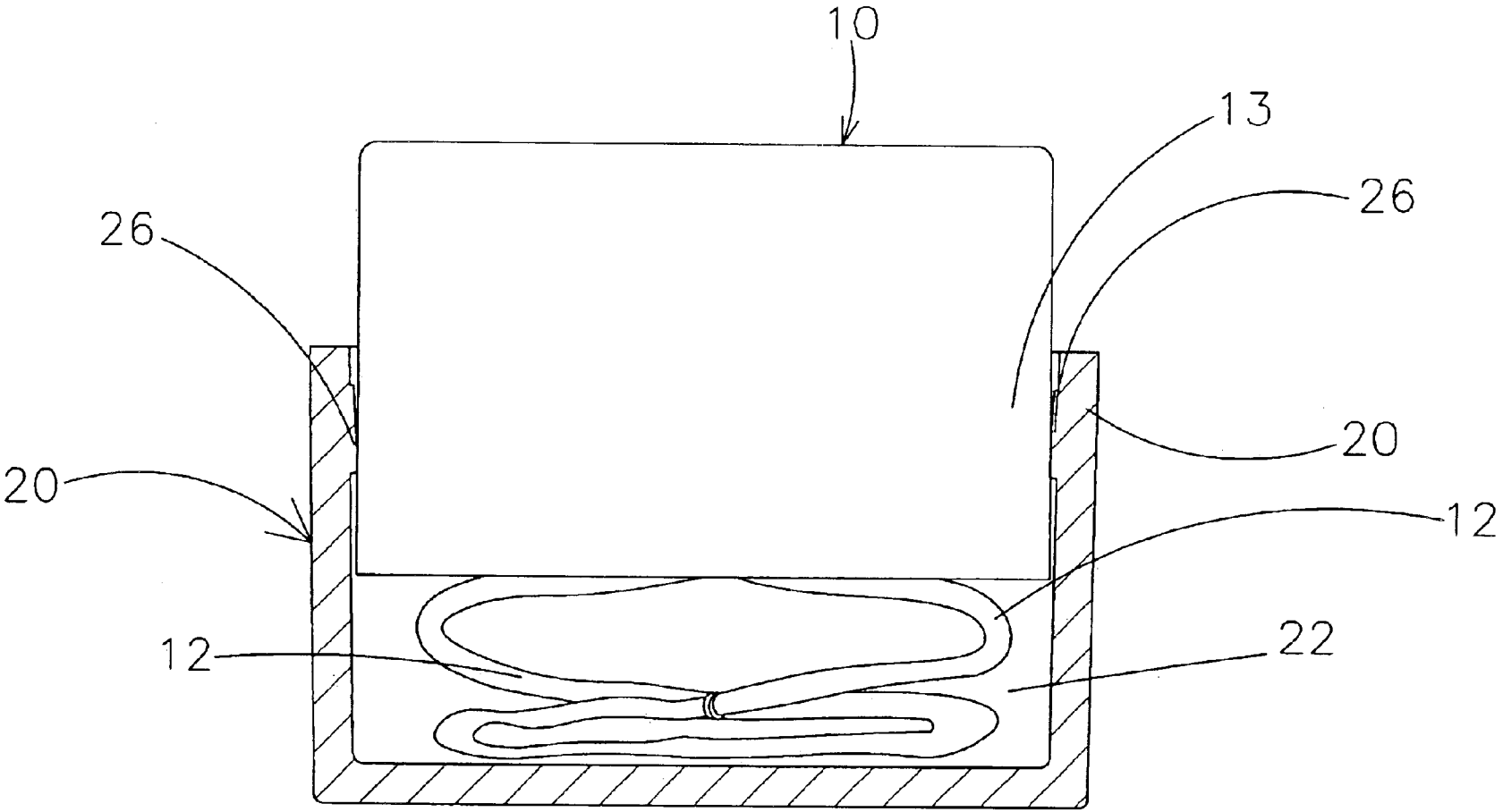
FIG. 7 shows a sectional view illustrating the socket housing wedged in the container according to the invention.
Figure 8:
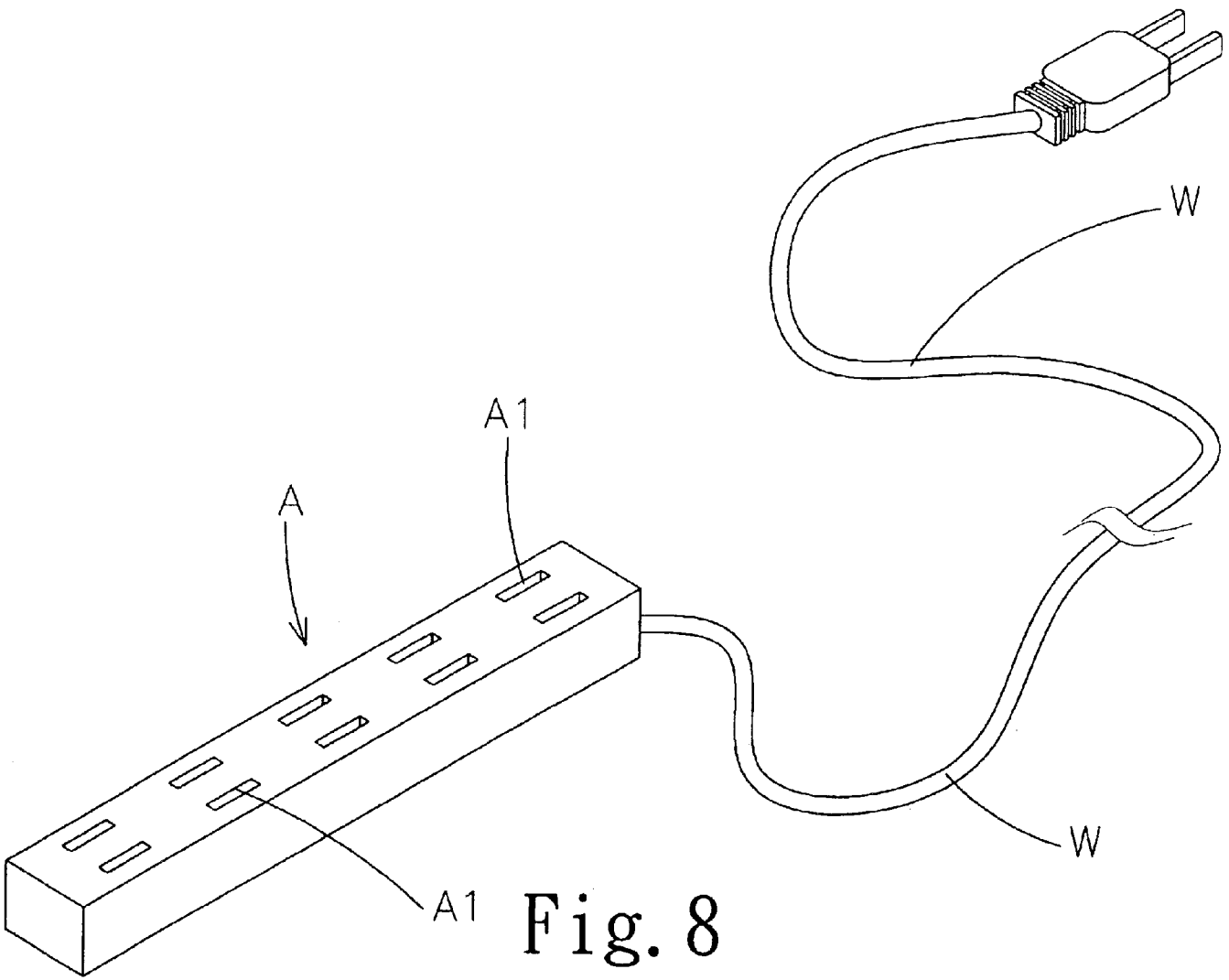
Fig. 8 (Prior Art)
FIG. 8 shows a conventional elevational view of a prior socket.

According to the aforesaid primary characteristics, wherein inner side walls of the container 20 have at least one flange body 26 as shown in FIG. 7.

Figure 3:
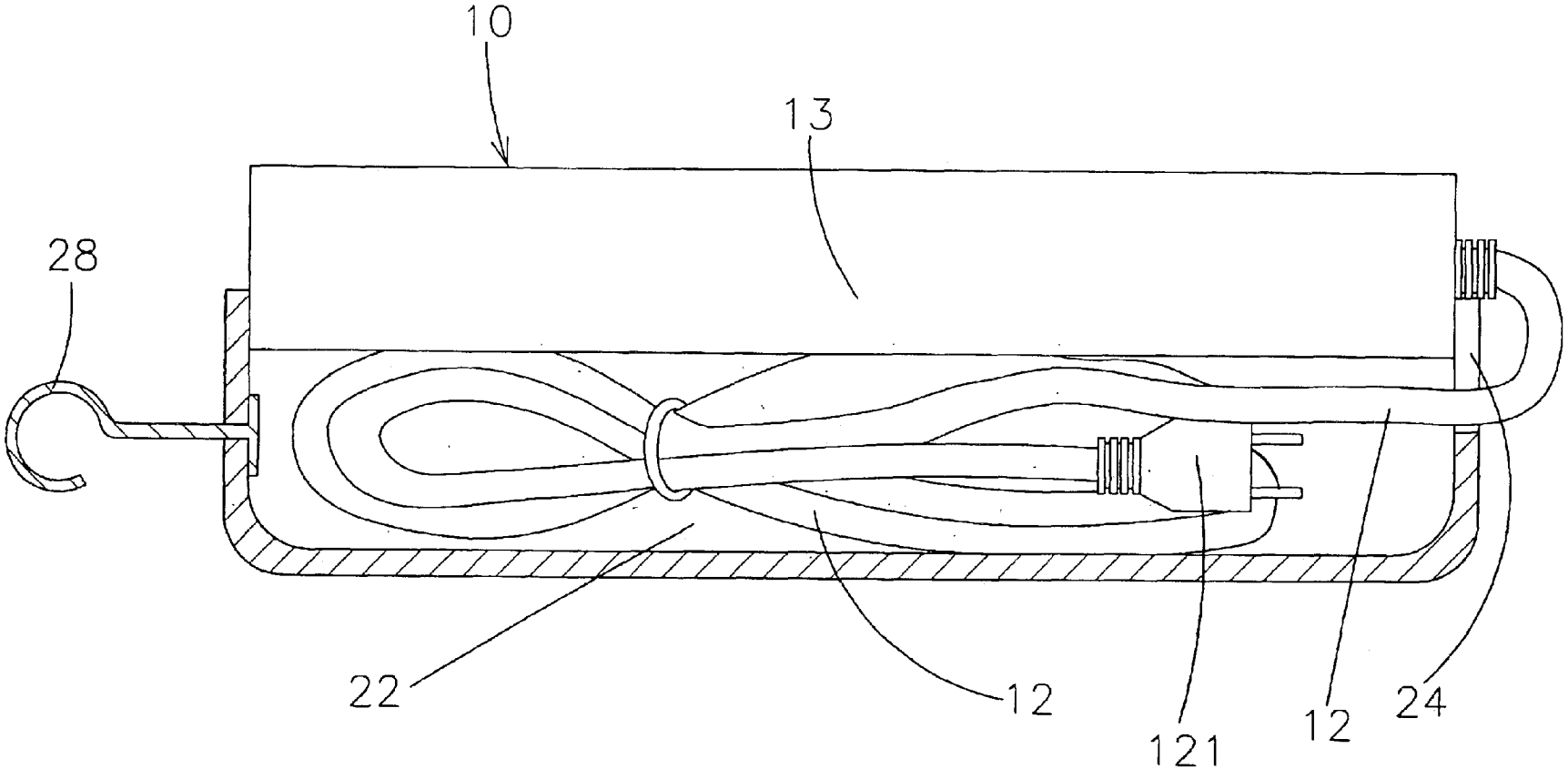
FIG. 3 shows a sectional schematic view according to the invention.

According to the aforesaid primary characteristics, wherein the extension wire 12 is coiled and stored in the accommodating chamber 22 of the container 20 as shown in FIG. 3.

According to the aforesaid primary characteristics, wherein an outer side of the container 20 has a projecting hook 28.

Figure 2:
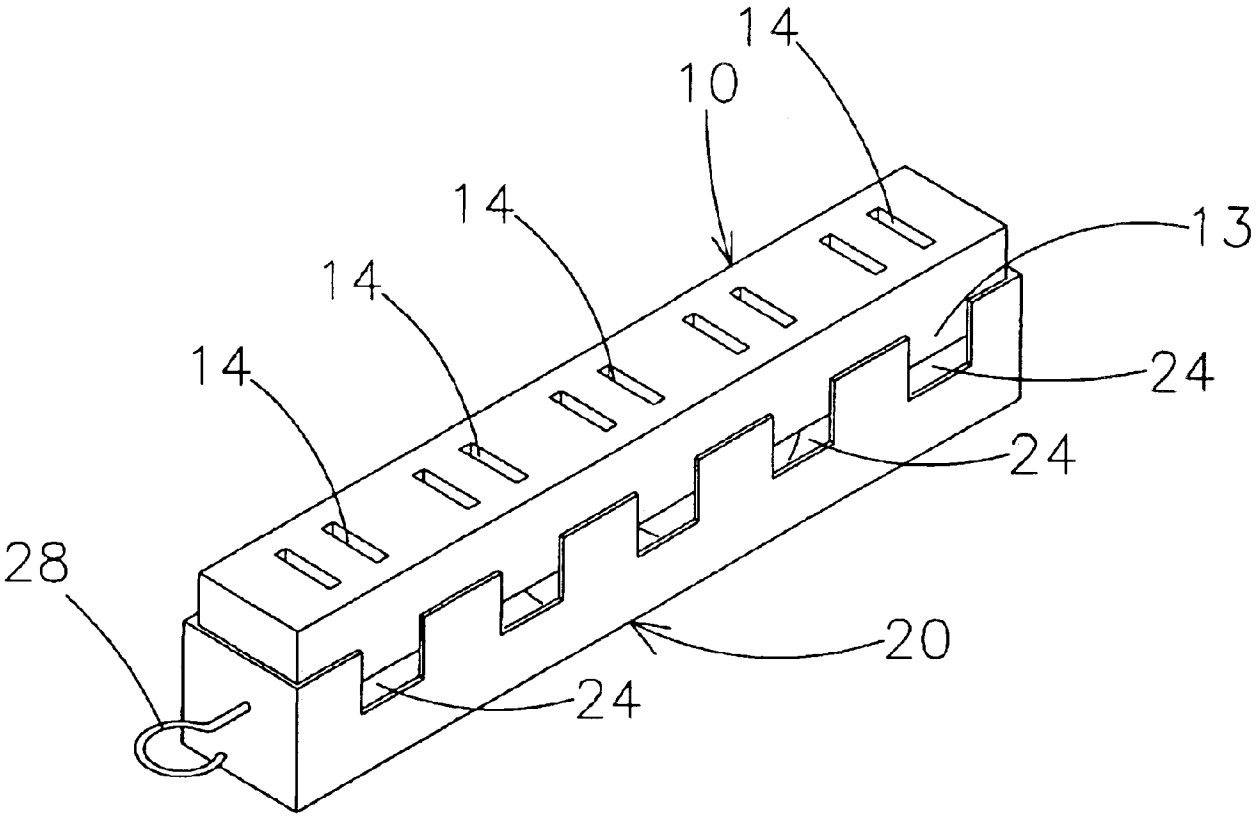
FIG. 2 shows an elevational view according to the invention.

Referring to FIGS. 1, 2 and 3, the extension wire 12 is coiled and thus readily stored Into the accommodating chamber 22, and the socket housing 10 is wedged into the accommodating chamber 22. At this point, in the presence of the flange bodies 26 at the inner walls of the container 20, the exterior 13 of the socket housing 10 is pressed against to coordinate with the flange bodies 26 as shown in FIG. 7. Thus, the socket housing 10 is steadily wedged and positioned in the accommodating chamber 22, and the extension wire 12 is stored in a concealed manner as shown in FIG. 3.

Figure 4:
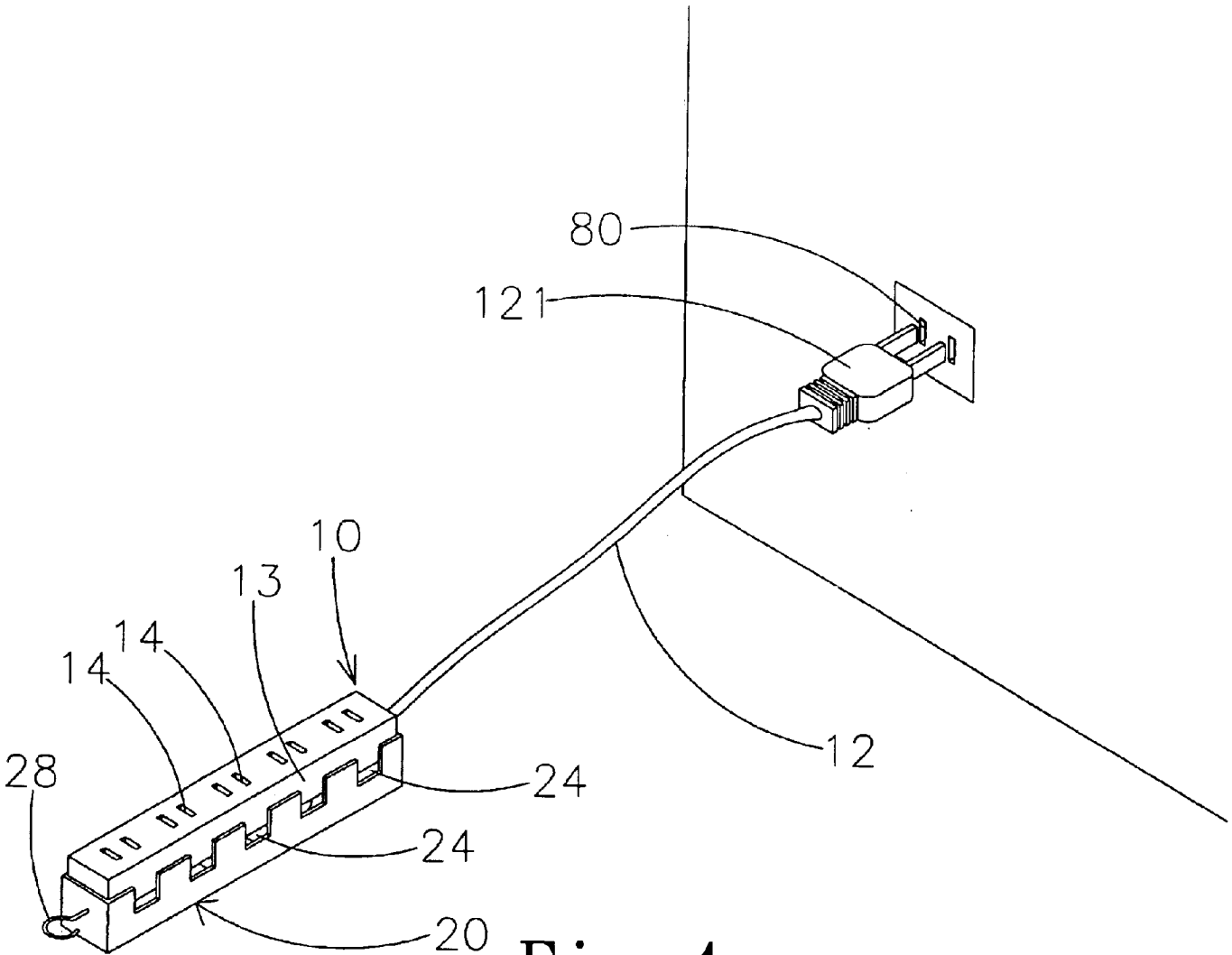
FIG. 4 shows an elevational view of an embodiment according to the invention.

Referring to FIG. 4, a plug 121 at an end of the extension wire 12 is inserted into receptacles 80. The extension wire 12 is extended with an appropriate length via a notch 24, with unnecessary extension wire 12 stored and concealed in the accommodating chamber 22. Therefore, the unnecessary extension wire 12 is not scattered to make a mess on the ground. Also, the container 20 is an elevated body, such that a lower surface of the socket housing 10 does not come into contact with the ground, and the socket housing 10 is also prevented from contacting with water in case of presence of water on the ground.

Figure 5:
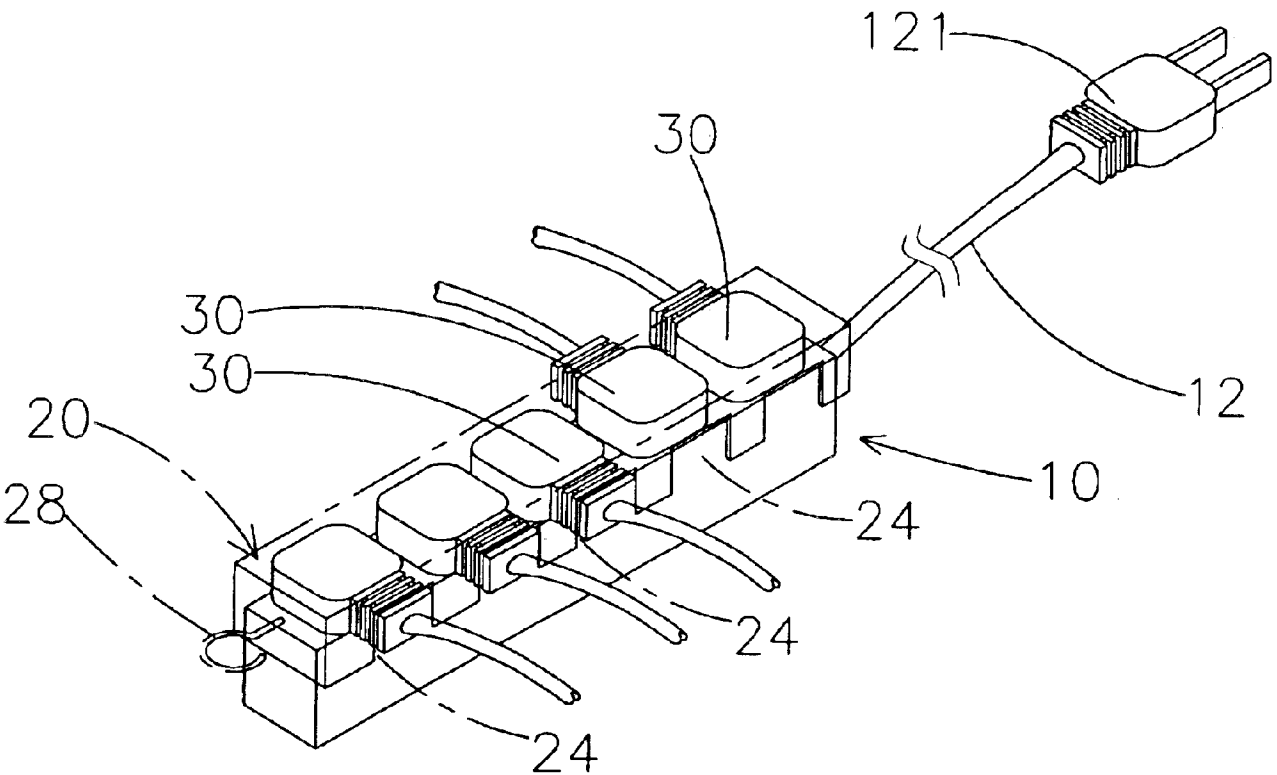
FIG. 5 shows an elevational view illustrating the container covered on top of the socket housing according to the invention.

Referring to FIG. 5, the container 20 is covered on top of the socket housing 10. Plugs 30 are inserted into the insertion openings 14, and each plug 30 is extended via the notch 24. A target of the above is to prevent water from splashing in an upward direction into the insertion openings 14.

Figure 6:
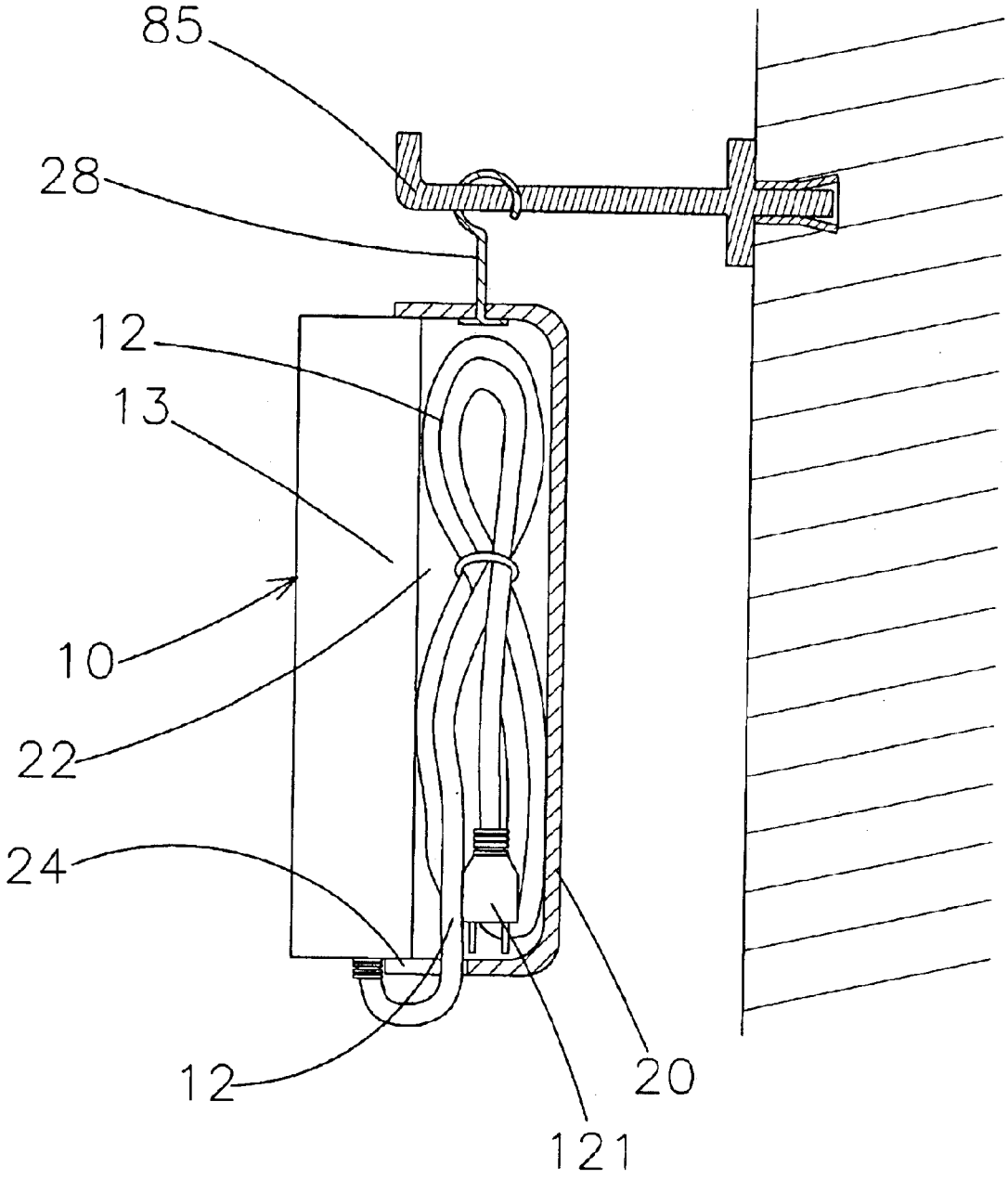
FIG. 6 shows a planar view illustrating the invention being suspended using a hanging assembly.

Referring to FIG. 6, the invention is suspended to a wall using a hanging assembly 28, so as to facilitate storage as well as accessing or displaying purposes.

Conclusive from the above, the invention comprising the attached container 20 and the socket housing 10 is capable of accomplishing objects as being waterproof and storing the extension wire 12 in a concealed manner.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A power socket having an attached container comprising:

a socket housing having a plurality of parallel elongated insertion openings for receiving a plug; and a single extension wire;

a container having a solid base, two solid upwardly extending end walls and two upwardly extending side walls defining an accommodating chamber; and wherein an exterior of the socket housing forms an outer cover of the accommodating chamber by wedging and joining to an upper surface of the socket housing, and forms an elevated body by covering a lower surface of the socket housing, and wherein a portion of the exterior wire is stored in the accommodating chamber.

2. The power socket having an attached container in accordance with claim 1, wherein side walls of the container have at least one notch.

3. The power socket having an attached container in accordance with claim 1, wherein inner walls of the container have at least one flange body.

4. The power socket having an attached container in accordance with claim 1, wherein the extension wire is coiled and stored in the accommodating chamber of the container.

5. The power socket having an attached container in accordance with claim 1, wherein an outer side of the container is provided with a hook.

* * * * *